US009775767B1

(12) United States Patent
Khaligh

(10) Patent No.: US 9,775,767 B1
(45) Date of Patent: Oct. 3, 2017

(54) NAHO DELUXE WALKER

(71) Applicant: Shahzadeh Khaligh, Rancho Palos Verdes, CA (US)

(72) Inventor: Shahzadeh Khaligh, Rancho Palos Verdes, CA (US)

(73) Assignee: Space Technology Research LLC, Rancho Palos Verdes, CA (US)

( * ) Notice: Subject to any disclaimer, the term of this patent is extended or adjusted under 35 U.S.C. 154(b) by 0 days.

(21) Appl. No.: 14/998,581

(22) Filed: Apr. 1, 2015

(51) Int. Cl.
*A61H 3/04* (2006.01)
*A47C 4/04* (2006.01)

(52) U.S. Cl.
CPC ..... *A61H 3/04* (2013.01); *A47C 4/04* (2013.01); *A61H 2201/1633* (2013.01); *A61H 2201/5025* (2013.01); *A61H 2201/5058* (2013.01)

(58) Field of Classification Search
CPC ..... A61H 3/00; A61H 3/04; A61H 3/061
USPC ..... 135/67, 85
See application file for complete search history.

(56) References Cited

U.S. PATENT DOCUMENTS

| | | | | |
|---|---|---|---|---|
| 5,224,721 | A * | 7/1993 | Santmann | A61H 3/04 135/67 |
| 5,636,651 | A * | 6/1997 | Einbinder | A61H 3/04 135/65 |
| 5,649,558 | A * | 7/1997 | Richard | A61H 3/00 135/67 |
| 8,490,637 | B2 * | 7/2013 | Schroeder | A45B 9/00 135/66 |
| 2014/0209133 | A1 * | 7/2014 | Pak | A61H 3/04 135/67 |
| 2015/0223577 | A1 * | 8/2015 | Troy, Jr. | A45B 9/04 135/67 |

* cited by examiner

*Primary Examiner* — Sarah McPartlin

(57) ABSTRACT

This invention pertains to advanced medical walker that provides tremendous safety to the users of the medical walker. The novelty introduced here is the addition of the foldable seat pads and safety legs to the medical walker to protect the user from falling down in an uncontrollable situation or fatigue condition, wherein falling down and its resulting traumatic injuries is a serious concern for the users who are in the low-energy state, or are without the accompany of a caring attendance. This invention addresses this concern. There is a wide variety of operation for this invention; this walker can be used in any private or public place such as private homes, hospitals, nursing homes, medical care centers, and alike.

4 Claims, 5 Drawing Sheets

NAHO DELUXE WALKER

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not applicable

FOREIGN APPLICATION DATA

N/A

BACKGROUND OF THE INVENTION

There is a wide range of population using variety of medical walkers offered in the marketplace. Most commonly, the walkers are in use by people with some kind of disabilities, elderly, people with short or long term injuries, and patients in hospitals, rehabilitations, and nursing homes. In some cases the user needs to be accompanied with a caring assistance and in other cases the user can independently operate the walker. In any events, sudden uncontrollable situation can lead to the user's fall-down and result in serious injuries depending on the severity of the fall.

This invention introduces a walker with seating capability that provides a safety mechanism to prevent the fall and its potential regretful damage(s). The safety mechanism introduced here is an addition to the prior developed arts that are already in use of public. In general a walker consists of 2 sides connected together with a front frame; each side has a front and rear frame connected together with side bars and hand grips that the user can use to support himself while using the walker; and 2 latches to fold and unfold the side frames against the front frame.

This innovative walker, in addition to the features listed above, has 4 safety legs that provide a fixed and stable position for the seating walker, and two drop-down seat pads that upon deployment, are available for the user to sit on. It also has two steel bars located at the lower end of each side above the front wheels that connect the front and rear frame of each side together providing additional stability. The legs and seat pads are held in place by latches and cable bars that are running inside the frames.

SUMMARY OF THE INVENTION

The NAHO Deployable Seat Medical walker is a new product introduced to the medical market. It is designed to save the users from falling in unstable conditions or unforeseeable fall situations. The safety feature provides additional control to the users and enables them to walk the desired distance more fearlessly and safely. Additionally, given this sense of independence, motivates the users to advance their activities and also reduces the needs to attending staff and frees them to other priorities.

The technology introduced here is a new safety feature that can be utilized by automatic or manual activation of connected sensors. The seating capability added to a foldable and moveable walker is the novelty claimed here. The safety operation begins by activation of the sensors located on the front handle bar on each side. Upon execution, the walker would convert to a seating chair by extending its four legs and two seat pads. The assemblies of the seat pads and the legs are of pull cable recoil-spring assembly type.

The sensors' activation toggles the system on each frame, releasing the tension cables that are holding the front and rear legs and the seat pads in place. As a result, the legs turn 90 degrees toward the ground and the seat pads drop down to the sitting position. The walker can resume its original configuration by a second push on the sensors. The sensors invert the toggle system, pull the cables on the recoil pulleys, and reverse the turns of the legs to neutral position; and the walker will resume its normal configuration.

BRIEF DESCRIPTION OF THE VIEWS OF THE DRAWING

FIGS. 2 (A and B) illustrate a top view of the Sensor, Toggle System, and the Control Pulleys of NAHO Deployable Seat Medical Walker.

FIG. 3 (A through D) illustrate the side views of the seat pads assembly. FIGS. 3A and 3C illustrate the position of the seat pads when the pull cable is in hold and FIGS. 3B and 3D illustrate the front view of the seat pads when the toggle has inverted and released the tension on the pull cable pulleys.

FIG. 3 (E through H) illustrate the side views of the legs assembly.

FIG. 4A illustrates the left side and FIG. 4B illustrates the right side of FIG. 1B respectively.

DETAILED DESCRIPTION OF THE INVENTION

Figure 1A:
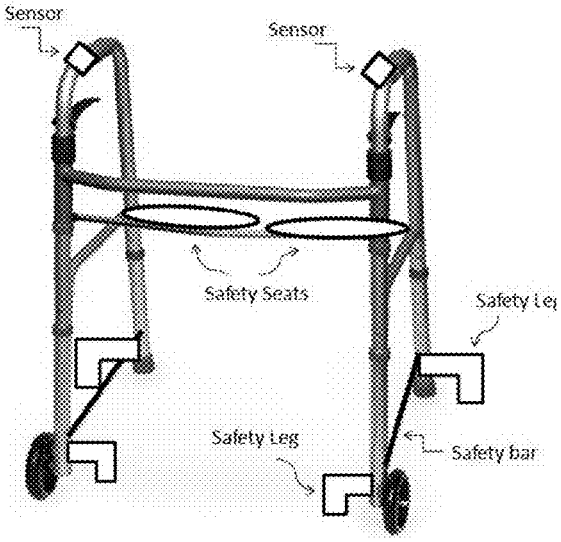
FIG. 1A illustrates a foldable and movable walker in the neutral position; that is the safety features reserved.
Figure 1B:
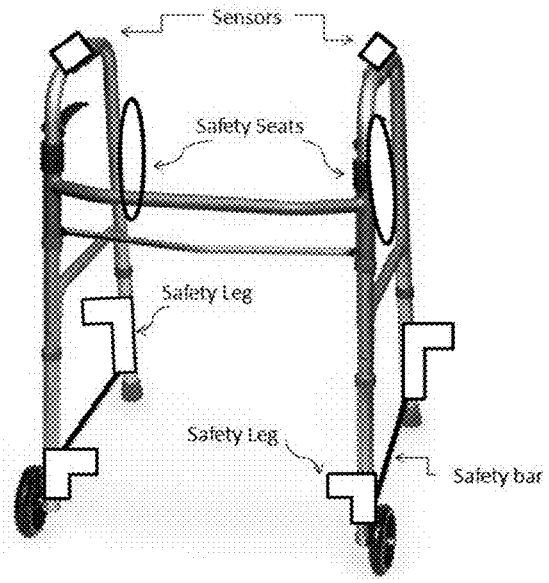
FIG. 1B illustrates the configuration of the walker in the sitting mode. The seat pads are dropped down, and the legs are extended securing the walker in a fixed stable chair position.

Referring to FIGS. 1 (A&B), there are two seat pads attached to the rear frames that, in the normal mode, are flipped up against the rear frames (1A) and during safety operation are flipped down horizontally in the space formed by the walker structure, pointing toward the opposite frame (1B). There are four safety legs, two of which are 8" in height and are used for rear stand. They are attached to the inner side of the rear frames above the safety bars (1A) and would rotate down 90 degrees out to the open space (1B). The other two legs are 5" in height, and are attached to the outer side of the front frames (1A). They would rotate down into the walker framework, and lock the front wheels (1B). There are two sensors located on the top front portion of the handle segment of the walker. These sensors are equipped with a digital scale to measure the distribution of the load on each frame; and beneath them, there are two snapping systems, one on each side that is controlling the pull cables in front and rear frames through their pulleys. Each of the four legs and the two seat pads operate on a pull cable spring-recoil assembly controlled by the snapping system attached to the sensors.

Figure 2A:
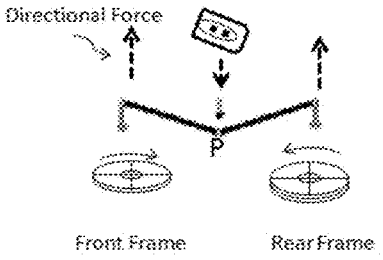
FIG. 2A illustrates the snap-through system in uphold position while exerting upward force on the pull cables (CW on the front control pulley and CCW on the rear control pulley of the right side frame of the walker).
Figure 2B:
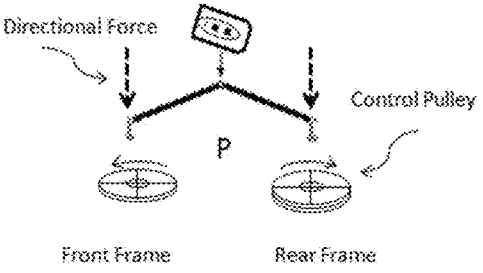
FIG. 2B illustrates the snap-through system inverted, and releasing the force on the pull cables. The control pulleys turn, right front pulley in CCW direction and the right rear pulley in CW direction.
Figure 3A:
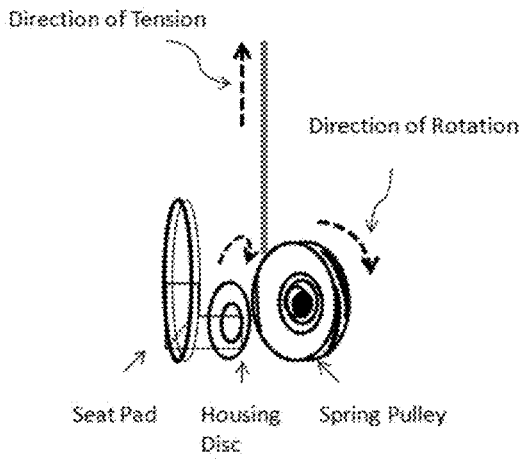
FIGS. 3A and 3B relate to the right side of FIGS. 1A and 1B respectively, and FIGS. 3C and 3D relate to left side of FIG. 1A and FIG. 1B respectively.
Figure 3B:
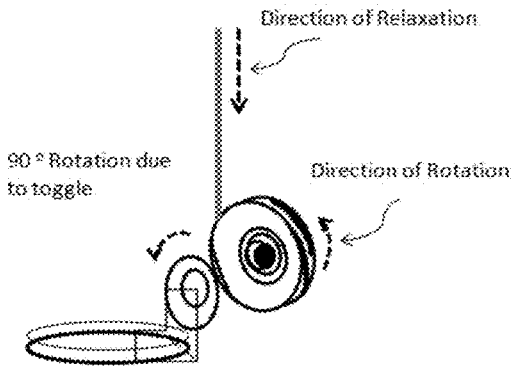
Figure 3C:
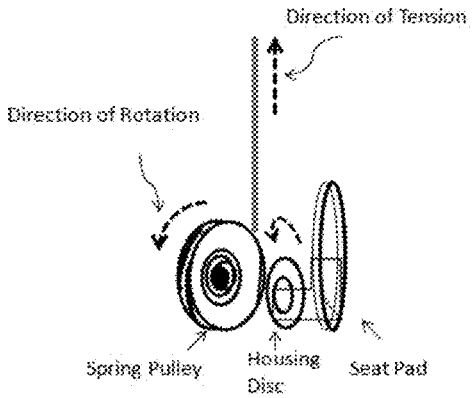
Figure 3D:
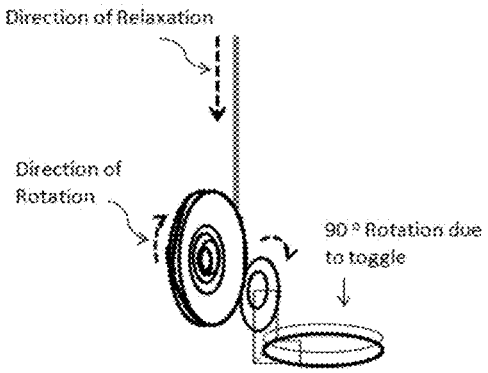
Figure 3E:
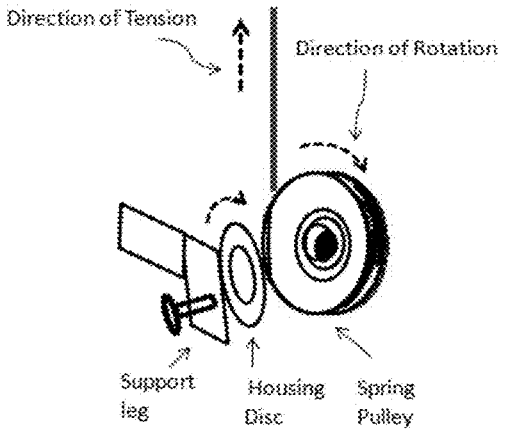
FIGS. 3E and 3G illustrate the uphold position of the legs due to the cable tension (in the direction shown) and FIGS. 3F and 3H illustrate the position of the legs (turned to the ground) when the cables are released.
Figure 3F:
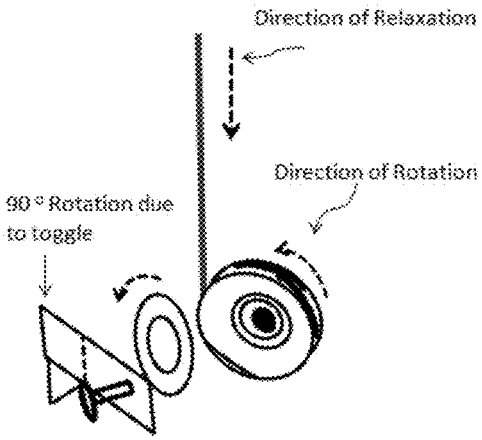
Figure 3G:
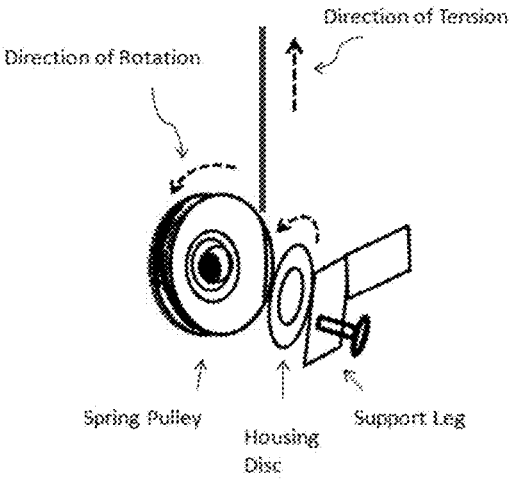
Figure 3H:
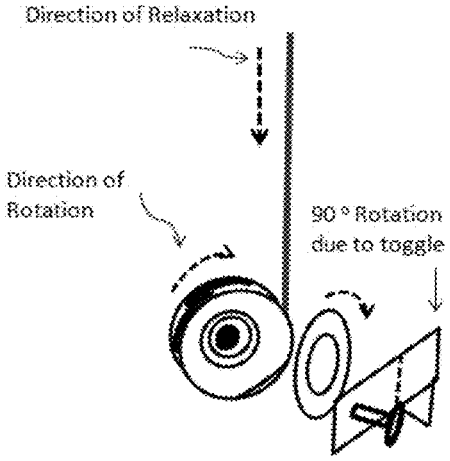
Figure 4A:
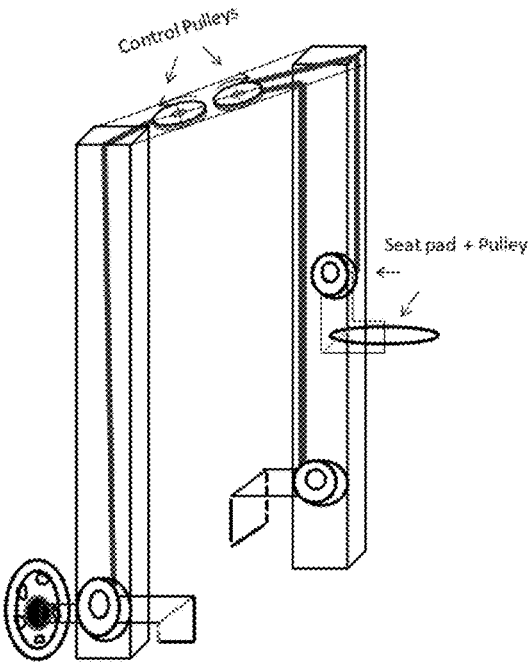
FIG. 4A-FIG. 4B illustrates the cabling and the pulleys' positions inside the frame on each side.
Figure 4B:
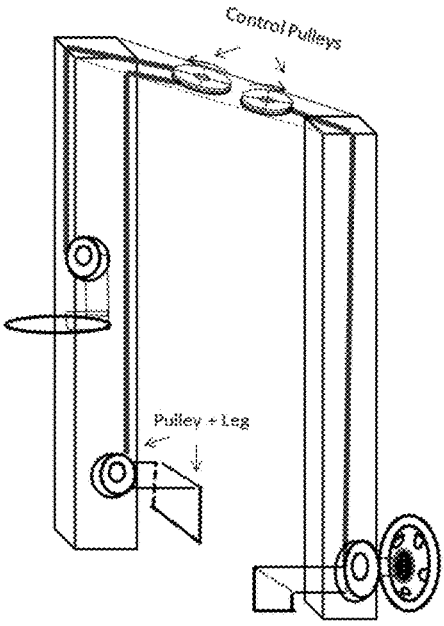
Figure 4C:
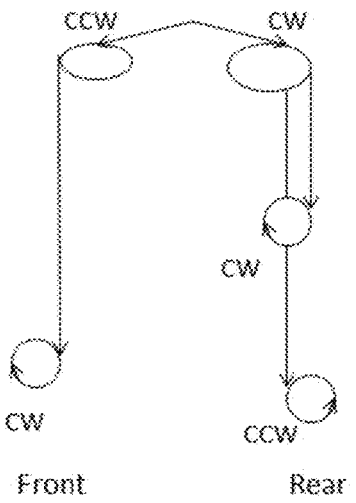
FIG. 4C illustrates the 3 cables and the direction of rotation of each pulley inside the frame of FIG. 4A.
Figure 4D:
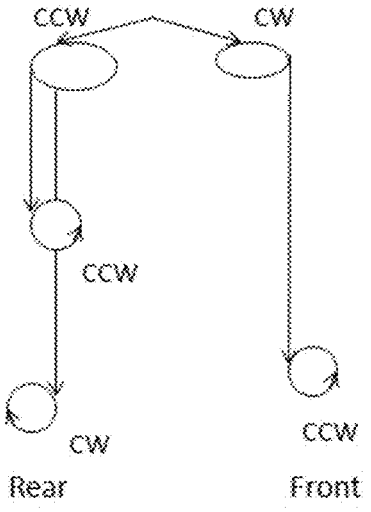
FIG. 4D illustrates the 3 cables and the rotational direction of each pulley inside the frame of FIG. 4B.

Referring to FIGS. 2A & 2B, these sensors are connected, on each side, to a snap-through toggle system that acts on a duplex control pulley. The mechanism of snap-through buckling system is basically a simple sudden toggle structure. The system has two shafts pinned together at the apex (P) where the load is applied and at the other end, pinned to a fixed point at the base of pulleys that control the pull cable. The connection point (P) is constrained by the symmetry to move only vertically.

Each of the sensors is connected to the snap-through system at the apex via a pin. When activated, manually or automatically, the pin exerts a force on the apex that inverts its position from (2A) to (2B). In position (2A), the pulleys are maintaining the pull cables and exerting tension on the recoil spring assemblies that hold the legs and the seat pads in place. When the snap-through system inverts to position (2B), the duplex control pulleys turn and release the tension on three pull cables of each side by freeforwarding the stored cables. The other end of each of the pull cables is attached to a recoil spring assembly that operates the front leg, the rear leg and the seat pad.

Each recoil-spring assembly has a housing that stores the spring that the pull cable is attached to. The cover to the housing is a disc. The seat pads and the legs are adjustably attached to the discs of the assembly system. When the system snaps and toggles down, it pulses a load on the control pulley. The pulley releases the tension on the pull cable in each frame. The release of the tension on the pull cable, allows the recoil spring turn to its steady state (zero-force). As a result, the disc attached to the housing would turn which causes the rotation of the attached element about its axis. The pull cable of the seat pad is controlled by the upper segment of the control pulley and the leg is controlled by the lower segment of the control pulley of the snapping system.

Referring to FIG. 3 (A through D), upon the release of the stored cable by the control pulley, the disc of seat pad in the right would turn CCW and the seat pad flips down as shown in 3B. The pulley and the disc of the seat pad in the left would turn CW as shown in 3D.

Referring to FIG. 3 (E through H), the mechanism of the rotation of the legs is such that the discs of the right rear leg and the left front leg would turn 90 degrees CW and the discs of the left rear leg and the right front leg would turn 90 degrees CCW. These figures illustrate the upheld and deployed position of the each of the legs and the direction of the turn of the discs for each. The rear legs would rotate 90 degrees out toward the open space, and land on the ground forming a wider stand. The front legs would rotate 90 degrees inside the walker framework, toward the opposite frame and lock the front wheels. The locked wheels and the 4 legs together secure a fixed position for the walker as if it was a chair.

FIG. 4 A-FIG. 4 B illustrates the integrated system inside the frame in each side; FIG. 4A illustrate the left side and FIG. 4B illustrates the right side of FIG. 1B respectively.

To convert back the walker to its normal configuration, a push on the sensor would invert the snap-through system to position (1A). As a result of this inversion, the toggle exerts a force perpendicular to the pulley surface in the opposite direction. Since the force is in the opposite direction, the pulley turns in opposite direction and rewinds the pull cable which in turn, exerts the pull tension on the spring recoil assembly. The discs turn, and as a result the legs would rotate back to their original positions.

The sensors can be activated manually or automatically. In the manual activation, the user pushes the button on the sensor. The sensor sends a pulse signal to the pin. The pin acts on the toggle system and the walker reconfigures to a seating walker by executing the safety operation. The auto reconfiguration occurs when the sensors measure an off balance of the distribution of the weight between the two frames—that is when the weight of the user is measured significantly more on one side than the other, which is a sign of instability of the user. In that condition, the sensor sends the pulse signal to the pin, and the seating configuration of the walker begins.

Product Specification

It is considered to use light aircraft quality aluminum with high strength for the side frames, high strength steal bar for the safety bars and safety legs, and light weight parachute quality fabric or a nest shape seat made of vinyl for the seat pads. The sensors work on replaceable battery.

Marketable Walker Specification:

| | |
|---|---|
| Length , Width, Height | 17"-18", 23"-24", 30"-40" |
| Seat height | 20"-24 " |
| Weight | 12-15 Lbs |
| Opening at base | 23"-24" plus additional 5"-6" on each side for the short legs |
| Color | Silver |
| Brand | TBD |
| Inside width between hand bars | 16"-17" |
| Material | Steel |
| capacity | 300 LB |

Additional specs:

The invention claimed is:

1. A medical walker comprising:

A frame comprising a right inverted u-shaped stand connected to a left inverted u-shaped stand—wherein each of the right inverted u-shaped stand and left inverted u-shaped stand comprises a front vertical support and a rear vertical support, a top support extending between two ends of the front vertical support and rear vertical support, a second support extending between the front vertical support and rear vertical support at mid points of the front vertical support and rear vertical support, and a safety bar extending between bottom positions of the front vertical support and rear vertical support forming a right side-frame and left side-frame;

each of the right side-frame and left side-frame further includes a sensor mounted on the top support, a pivotal seat pad mounted on the rear vertical support by way of a first recoil-spring assembly and two foldable safety legs mounted by way of a second recoil-spring assembly and a third recoil-spring assembly on a bottom end of each of the front vertical support and the rear vertical support;

wherein the sensor is activated by either a manual push button actuated by a user or automatically by measurement of an off balance distribution of weight between the right side-frame and the left side-frame and upon activation of the sensor a toggle is released rotating two control pulleys and releasing tension on three pull cables, one of each of the three pull cables is attached to each of the first, second and third recoil-pulley-spring-assemblies, wherein releasing tension on the three pull cables causes rotation of each recoil pulley-spring assembly and deployment of—the pivotal seat pad from a folded configuration to a use configuration and deployment of each of the safety legs from a withdrawn configuration to a deployed configuration.

2. The walker of claim 1 wherein wheels are attached to each of the front vertical supports and wheels are locked when the safety legs are in the deployed configuration.

3. The walker of claim 1 wherein each foldable safety leg is vertically adjustable with respect to the frame.

4. The walker of claim 1 wherein each pivotal seat pad is adjustable with respect to frame.

* * * * *